US006475318B2

(12) United States Patent
Weiss

(10) Patent No.: US 6,475,318 B2
(45) Date of Patent: Nov. 5, 2002

(54) METHOD FOR CREATING A DESIGN USING MULTIPLE PIECES OF MATERIAL

(76) Inventor: Jeffrey D. Weiss, 18 Evergreen Pkwy., Westport, CT (US) 06880

( * ) Notice: Subject to any disclaimer, the term of this patent is extended or adjusted under 35 U.S.C. 154(b) by 94 days.

(21) Appl. No.: 09/764,470

(22) Filed: Jan. 17, 2001

(65) Prior Publication Data

US 2002/0094411 A1 Jul. 18, 2002

(51) Int. Cl.[7] ..... B32B 7/08

(52) U.S. Cl. ..... 156/93; 156/226; 156/227; 156/267; 156/299

(58) Field of Search ..... 156/93, 226, 227, 156/267, 299

(56) References Cited

U.S. PATENT DOCUMENTS

| | | | | |
|---|---|---|---|---|
| 1,618,809 A | * | 2/1927 | Byron et al. | 112/419 |
| 1,742,117 A | * | 12/1929 | Aaron et al. | 112/419 |
| 1,791,836 A | * | 2/1931 | Ordway et al. | 12/146 CK |
| 4,365,355 A | * | 12/1982 | Off et al. | 2/247 |
| 4,646,666 A | | 3/1987 | Burrier | |

* cited by examiner

*Primary Examiner*—Michael W. Ball
*Assistant Examiner*—Gladys Piazza
(74) *Attorney, Agent, or Firm*—Skadden, Arps, Slate Meagher & Flom LLP

(57) ABSTRACT

A method is disclosed for creating a design that appears to float in the face of a piece of material. A piece of fusible material is placed on top of a first piece of material. The fusible material is coated with an adhesive. The non-adhesive side of the fusible material is in contact with the face side of the first piece of material. The fusible material is sewn to the first piece of material. The stitches define the periphery of an unbroken design. The fusible material is trimmed outside the periphery of the unbroken design. Next, the fusible material and the fabric are trimmed inside the unbroken design to create an aperture. The fusible material is pulled through the aperture so that the adhesive is substantially interposed between fusible material the reverse side of the first piece of material. The fusible material is then fused to the reverse side of the first piece of material. A second piece of material is placed on the reverse side of the piece of fabric to cover the aperture. Finally, the second piece of material is sewn to the fabric thereby creating a design that appears to float in the first piece of fabric.

11 Claims, 8 Drawing Sheets

METHOD FOR CREATING A DESIGN USING MULTIPLE PIECES OF MATERIAL

FIELD OF THE INVENTION

This invention relates to adding designs to fabric, and more specifically, to creating a fabric design that appears to float in the face of a piece of fabric.

BACKGROUND OF THE INVENTION

It is well known to put designs and ornamentation on materials or fabrics used for garments. Many different techniques are used to create designs on fabrics including printing, and appliqués. When a design is printed on a piece of fabric, it is a long and expensive process, not suited for small pieces of material. This process also hampers an artist or designers ability to create unique pieces. Additionally, a printed design does not allow a designer to mix different types of materials to create a design. In an effort to mix various materials, appliqués have been used. Appliqués are sewn onto the face of a piece of fabric or glued in place on the face of a piece of fabric. Appliqués or patches applied to the face of the fabric tend to curl at the edges. In the case of a garment, during normal wear, appliqués are easily damaged.

One attempt to create a design that appears to float in the face of a piece of fabric is shown in FIG. 11. A pattern is cut in the face of a piece of fabric 100. The edges of the pattern are folded under and a second piece of fabric 102 is then placed on the reverse side of the first piece of fabric. The second piece of fabric 102 is then top stitched in place. This gives the overall design a seamless appearance. This method, while creating a design that appears to float in the face of the fabric, is difficult to sew due to the flexibility of the folded under seam. The folded under seam is loose and difficult to keep in place prior to attaching the second piece of fabric 102. What is needed is an easy and inexpensive method to create a unique design that appears to float in the face of a piece of fabric.

BRIEF SUMMARY OF THE INVENTION

The present invention overcomes these problems by providing an improved method for creating a design that appears to float in the face of a piece of material. The present invention provides a creative tool for transitioning from one piece of fabric to a second piece of fabric and preventing both pieces of fabric from unraveling. According to one embodiment of the present invention, a piece of fusible material is placed on top of a first piece of material. The fusible material is coated with an adhesive on the side opposite the first piece of material, the face side of the fusible material. The non-coated side of the fusible material is in contact with the first piece of material. The fusible material is sewn to the first piece of material. The stitches define the periphery of an unbroken design. In one embodiment of the invention, the design is at the edge of the first piece of material. The fusible material is trimmed outside the periphery of the unbroken design. Next, the fusible material and the fabric are trimmed inside the periphery of the unbroken design to create an aperture. The fusible material is pulled through the aperture so that the adhesive is substantially interposed between fusible material and the reverse side of the first piece of material. The fusible material is then fused to the reverse side of the first piece of material. A second piece of material is placed on the reverse side of the piece of material to cover the aperture. Finally, the second piece of material is sewn to the first piece of material, thereby creating a design that appears to float in the first piece of fabric.

DETAILED DESCRIPTION OF THE INVENTION

Figure 1:
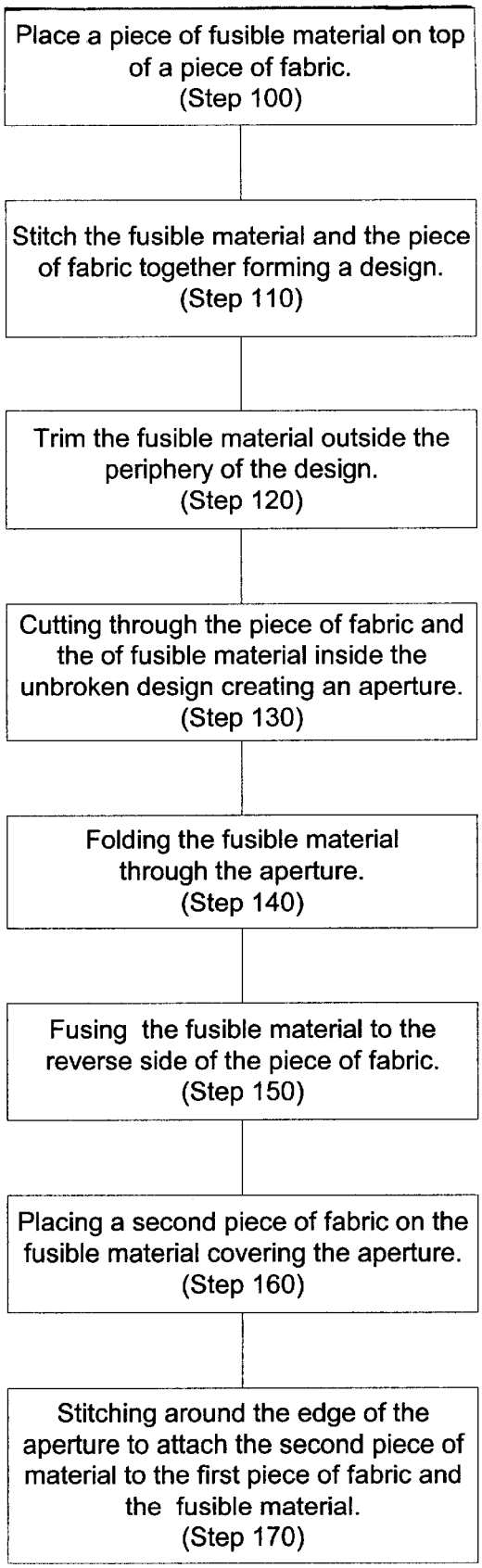
FIG. 1 is a flowchart illustrating a process for creating a design that appears to float in a piece of fabric.

FIG. 1 is a flowchart illustrating the inventive process that acts as a transition from one piece of material to another, which creates a design that appears to float in a piece of fabric. First, a piece of fusible material is placed on top of a piece of fabric (Step 100). The fusible material and the piece of fabric are then sewn together (Step 110). The stitch line forms a design. In one embodiment, the stitch line forms an unbroken design, i.e., the beginning and end of the stitch line meet. The fusible material outside the design is then trimmed (Step 120). The fusible material and the fabric are removed to create an aperture in the shape of the unbroken design (Step 130). Once the aperture is created, the fusible material is folded through the aperture so that no fusible material is visible from the face side of the fabric (Step 140). The fusible material is then fused to the reverse side of the piece of fabric (Step 150). Next, a second piece of fabric is placed on the fusible material, which is on the reverse side of the first piece of fabric, to cover the aperture completing the floating design (Step 160). The second piece of material is placed so that the face side of the second piece of fabric is visible through the aperture. Finally, the second piece of material is stitched in place, the stitches following the edge of the aperture (Step 170).

In one embodiment, the design is at the edge of the first piece of fabric. In this embodiment, the process is used as a transition from the first piece of material to the second piece of material. First, a piece of fusible material is placed on top of a piece of fabric. The fusible material and the piece of fabric are then sewn together. The stitch line forms a design. The design is at the edge or hem of the first piece of fabric. The fusible material outside the design is then trimmed. The fusible material and the fabric are removed to create an open area in the shape of the design. Once the open area is created, the fusible material is folded along the design creating a fold line so that no fusible material is visible from the face side of the fabric. The fusible material is then fused to the reverse side of the piece of fabric. Next, a second piece of fabric is placed on the fusible material, which is on the reverse side of the first piece of fabric, to cover the open area completing the floating design. The second piece of material is placed so that the face side of the second piece of fabric is visible through the open area. Finally, the second piece of material is stitched in place, the stitches following the edge of the fold line.

Figure 2:
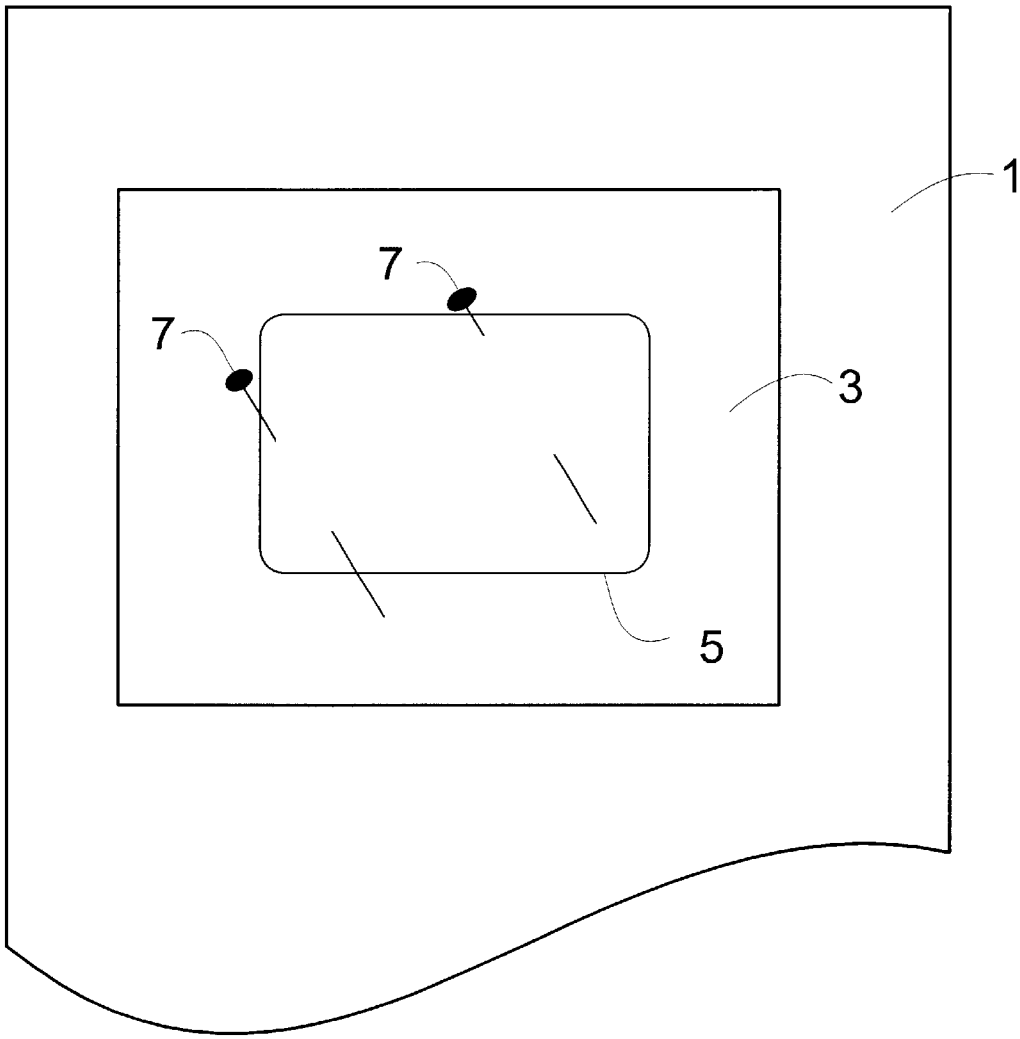
FIG. 2 illustrates a piece of fusible material placed on the face side of a piece of material.
Figure 3:
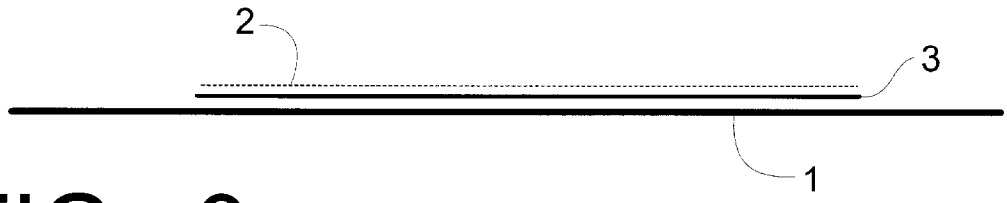
FIG. 3 illustrates a side view of a piece of fusible material placed on the face side of a piece of material.

FIG. 2 further illustrates the first step in the method for creating a design in a piece of fabric (FIG. 1, Step 100). Shown is the face side of a piece of fabric 1. The face side of the fabric is the side of a fabric seen on a finished garment. A piece of fusible material, 3, is placed on the face side of the piece of fabric 1. The fusible material 3 is an adhesive-backed fabric. The adhesive is pressure or heat sensitive. In one embodiment, the adhesive is permeated throughout the fabric. As shown in FIG. 3, the fusible material 3 is placed with the adhesive 2 up, away from the face side of the piece of fabric 1. The weight of the fusible material 3 is preferably chosen to match the weight of the fabric 1. Preferably, the fusible material is non-woven or non-knit. While woven fusible materials can be used, extra care is taken during the turning step (FIG. 1, Step 140). In one embodiment of the invention, the fabric 1 and the fusible material 3 are held together with pins 7 while they are being worked on. In another embodiment, the two materials are tacked or basted together.

The outline of the design 5 is drawn on the adhesive side of the fusible material. The design 5 is hand-drawn, computer plotted (including laser-guided cutting), or template guided using pencil, wax, silk-screening, or the like. In one embodiment, the fusible material 3 has a design already printed on it. The design is not limited to geometric shapes such as squares, rectangles, circles, or stars, as any design may be used. In one embodiment, the design utilizes the edge of the material to form the unbroken design. The material used to draw the design is selected considering the entire process. The drawing material is selected to prevent bleed-through, staining, or shadowing during pressing. In one embodiment, the stitching (FIG. 1, Step 110) creates the design; therefore, no design 5 is drawn.

Figure 4:
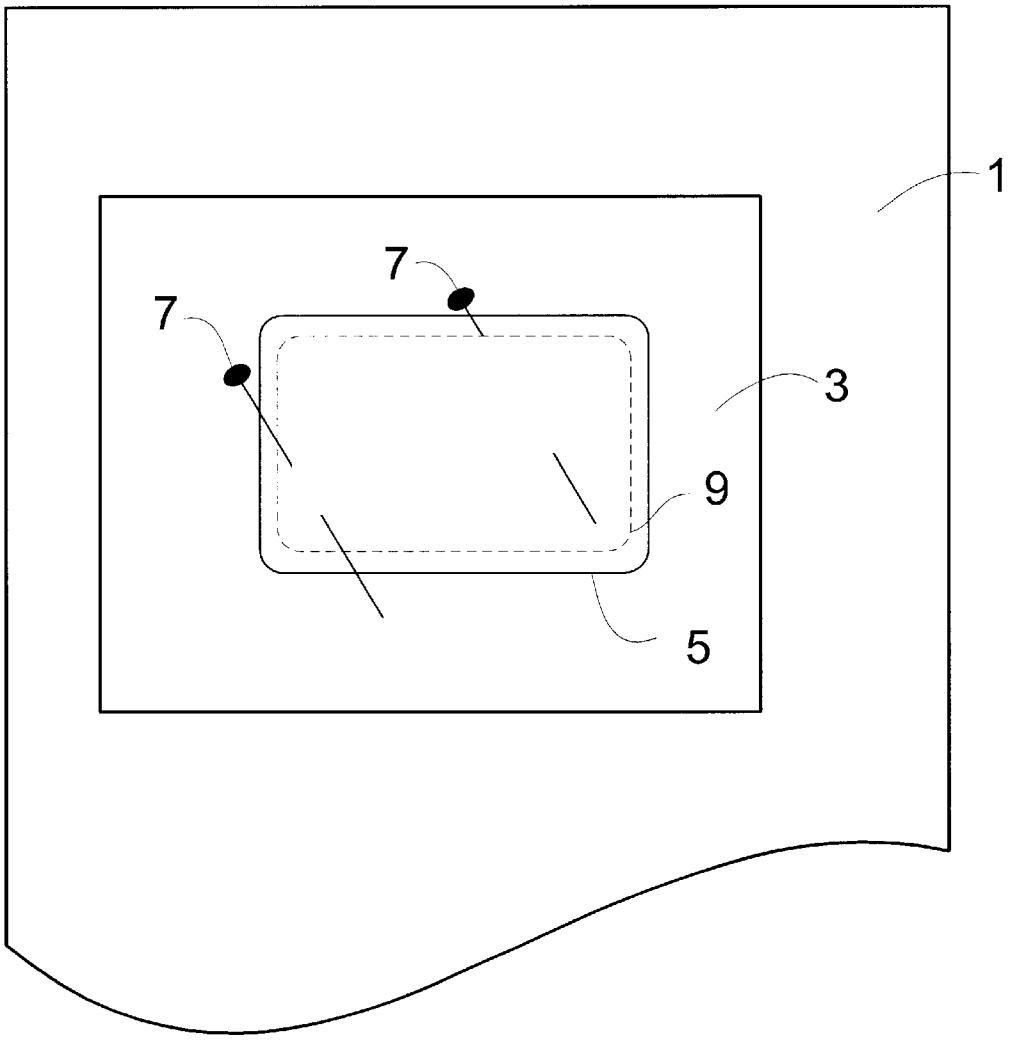
FIG. 4 illustrates a piece of fusible material stitched to the face side of a piece of material.

FIG. 4 illustrates a piece of fusible material 3 stitched to the face side of the piece of fabric 1 in accordance with Step 110 above. As shown, the stitching 9 is on the edge of the design 5. Preferably, the stitching is performed with a single-needle sewing machine using 8 to 15 stitches per inch. As is known in the art, finer fabrics such as linen or silk require higher stitches per inch, whereas heavier fabrics such as denim or rubberized cottons require fewer stitches per inch. The stitching 9 is sufficient to hold the fusible material 3 to the piece of fabric and to prevent the warp and weft of a piece of fabric or the knit on a piece of fabric from pulling apart or unraveling. Preferably, the thread is cotton wrapped polyester. Thread is selected such that the thread is not stronger than the fabric, thereby limiting the hazard of the thread tearing through the fabric. In one embodiment, the fabric and fusible material are plastic, vinyl, or other heat fusible materials, which are welded together by melting the materials using a heat source, i.e., a laser, in place of sewing.

Figure 5:
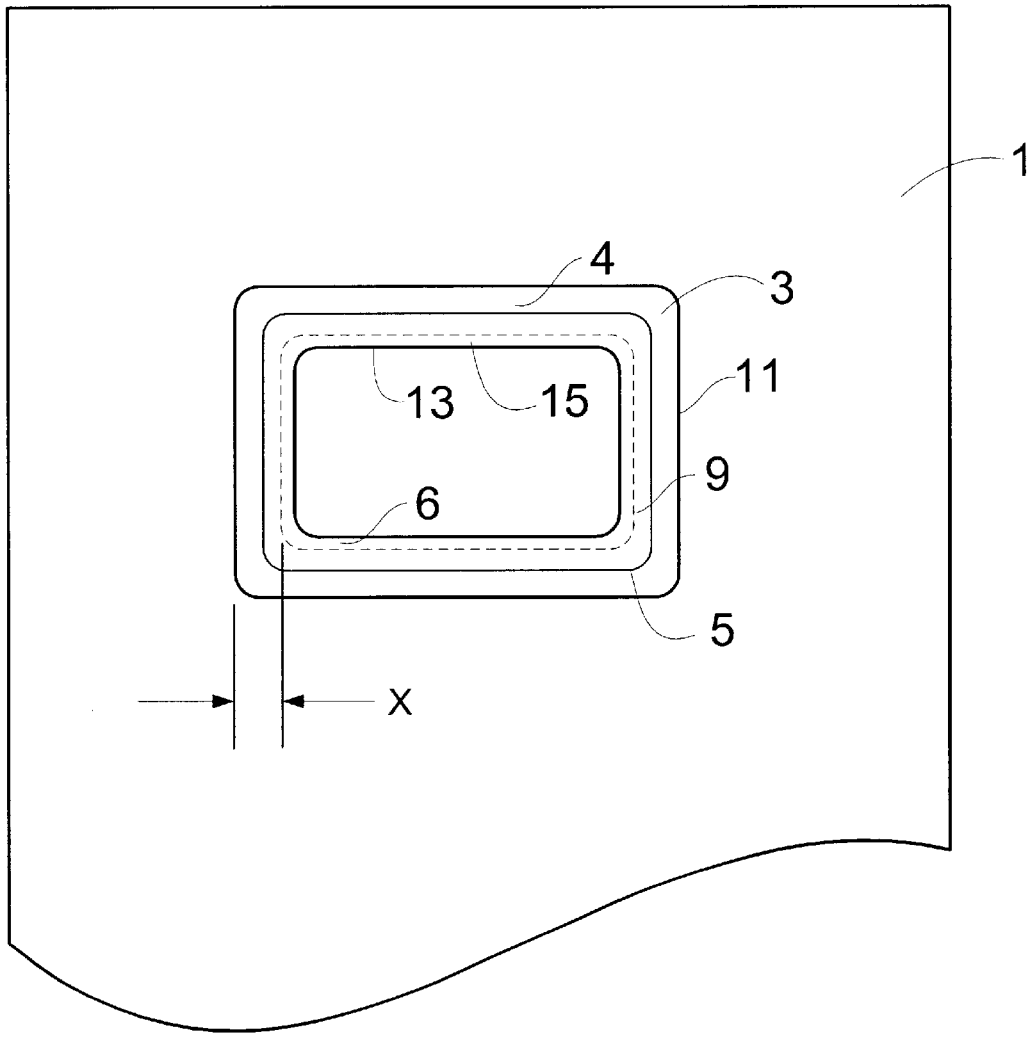
FIG. 5 illustrates a piece of fusible material stitched to the face side of a piece of material and trimmed.

After the fusible material 3 is stitched to the face of the fabric 1, the fusible material 3 and the fabric 1 are trimmed. As shown in FIG. 5, the fusible material 3 is trimmed a distance X from the stitching 9, outside design line 5 (FIG. 1, Step 120). Preferably, the distance X is about ¼ to ½ inch. A piece of the fusible material 4 remains, this piece of fusible material is turned under during subsequent processing (FIG. 1, Step 140). The fusible material and the fabric are cut through inside design line 5 creating aperture 15 (FIG. 1, Step 130). The fusible material 3 and the fabric 1 are cut about ⅙ to ⅛ inch away from the stitching 9, leaving hem 6. Thicker fabrics require more material to be left after trimming. The layers of fabric are cut using a single needle edge cutter, scissor, razor blade, knife, die cutter, or the like. When a die cutter is used, a design need not be drawn on the fusible material. When trimming designs that have sharp angles, such as stars, the trimming is done to the point, without cutting through the stitch. In the case of stars, there is no hem 6 at the points of the star.

Figure 6:
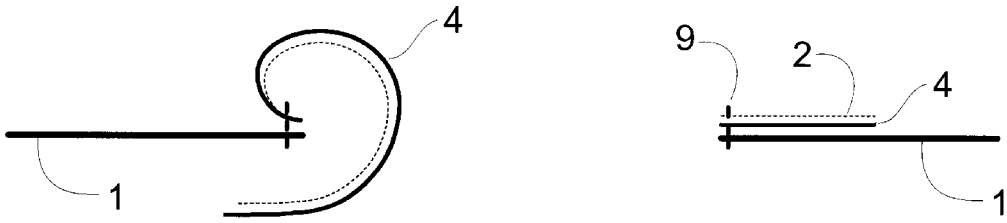
FIG. 6 illustrates a side view of a piece of fusible material being turned under.
Figure 7:
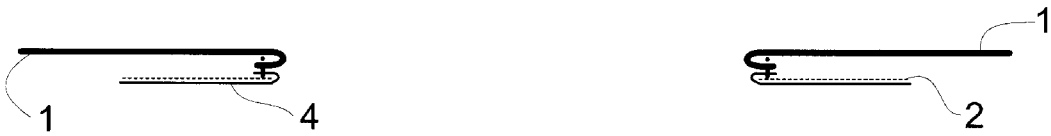
FIG. 7 illustrates a side view of a piece of fusible material turned under and fused.

As shown in FIG. 6, the piece of fusible material 4 is pulled through the aperture (15, FIG. 5) created when the fabric 1 and fusible material 3 were trimmed (FIG. 1, Step 140). The fusible material 4 is grasped and pulled through the aperture using tweezers or the like. The fusible material remaining after trimming is pulled completely through leaving no fusible material visible on the face of the fabric 1. As seen in FIG. 7, the fusible material 4, folded under to the reverse side of the fabric 1, is preferably pulled in slightly from the edge of the aperture. After the fusible material 4 is folded under, the adhesive is interposed between the reverse side of the fabric 1 and the fusible material. The materials are then fused together. The type of adhesive determines the fusing process used on the fusible material, i.e., pressure for pressure sensitive adhesives, heat for heat sensitive adhesives. The fused material provides a firm substrate for a second piece of fabric, which completes the design.

Figure 8:
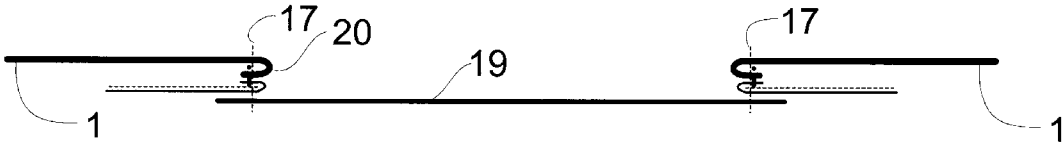
FIG. 8 illustrates a side view of a finished design.

As shown in FIG. 8, a second piece of fabric 19 is added to complete the design after the fusible material is fused to the reverse side of the fabric 1 (FIG. 1, Step 160). Any type of fabric is used as the second piece of fabric 19. In one embodiment, the second piece of fabric 19 is temporarily held in place using glue, pins, tape, or the like. The second piece of fabric 19 is topstitched in place by sewing along the design edge using a close stitch such as 12 to 15 stitches per inch (FIG. 1, Step 170). The stitches 17 are preferably as close as possible to the folded edge of the design 20. In one embodiment, the first piece of fabric 1 and the second piece of fabric 19 are the same material. Using the same material for the first piece of fabric 1 and the second piece of fabric 19 permits repairing damaged portions of the piece of fabric 1 easily and economically. In one embodiment, the materials are plastic, vinyl, or other heat fusible materials, which are welded together by melting the materials using a heat source, i.e., a laser, in place of sewing. Once topstitching is complete, the finished piece is pressed on the reverse side, preferably using a steam iron on a padded vacuum board.

Figure 9:
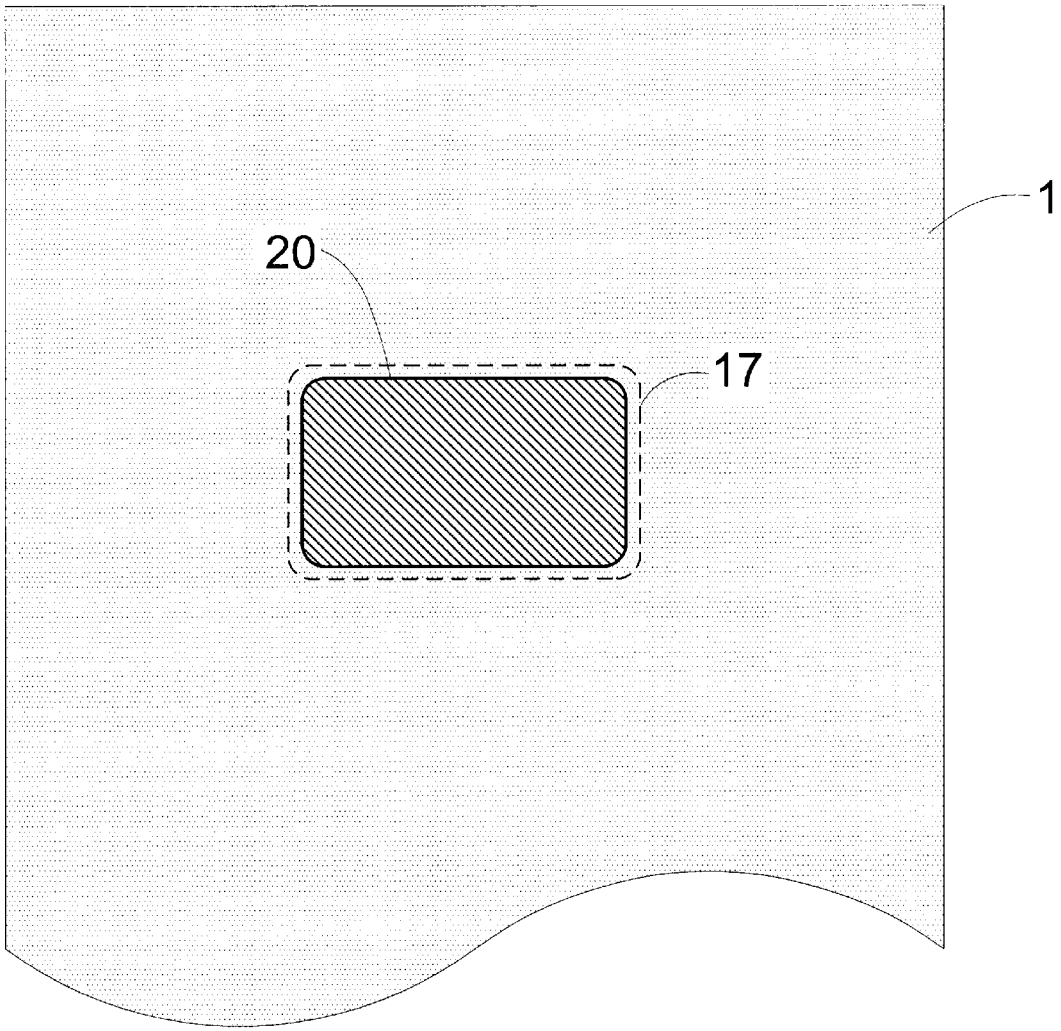
FIGS. 9 and 9A illustrate face views of finished designs.
Figure 10:
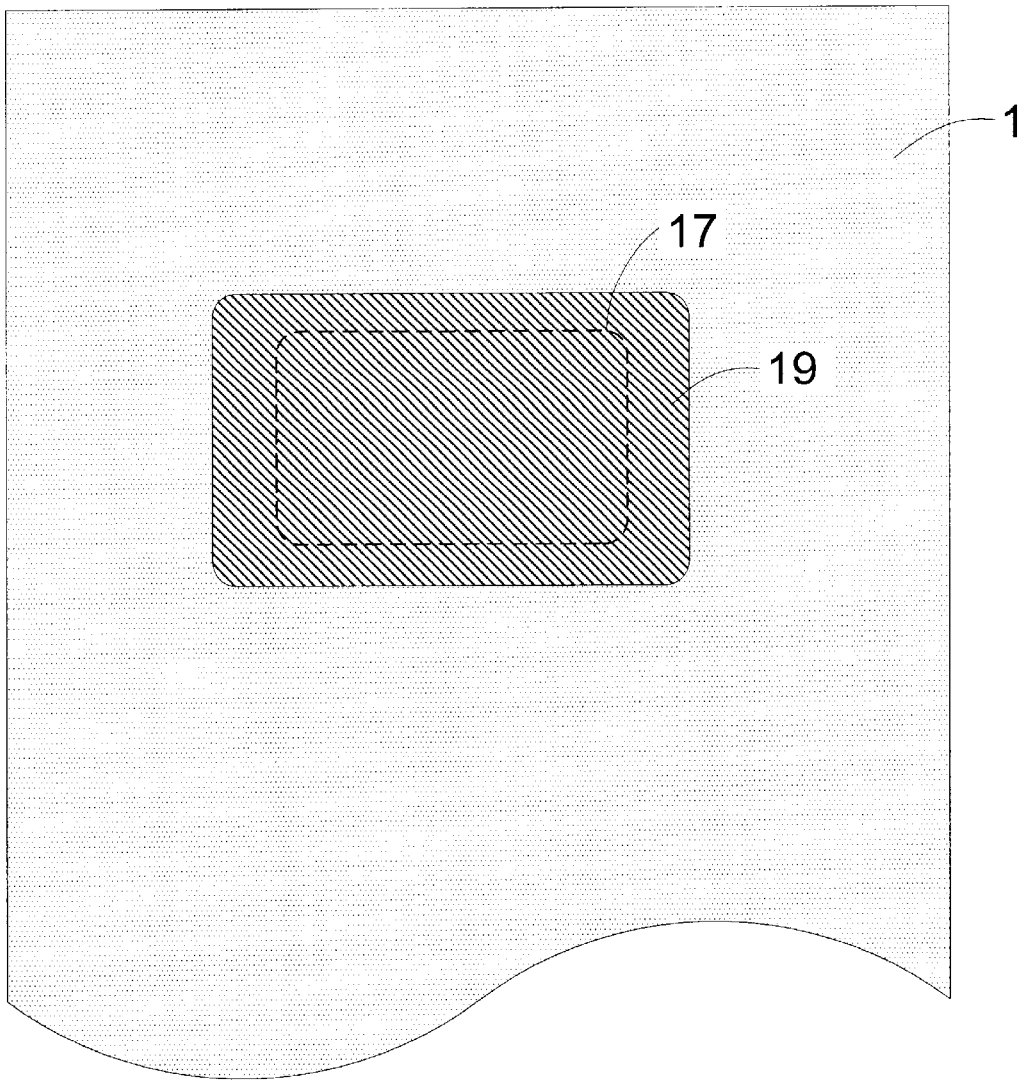
FIG. 10 illustrates a reverse view a finished design.

FIG. 9 illustrates the face view of the finished design. The finished design appears to have no indentation and no fusible material visible. The second piece of fabric 19 is larger than the folded edge of the design 20. The reverse view of the finished product is shown in FIG. 10. As shown, the second piece of fabric 19 extends beyond the stitching 17, which is at the edge of the design 20. In one embodiment, the second piece of material 19 is made from several smaller pieces of material pieced together.

Figure 9A:
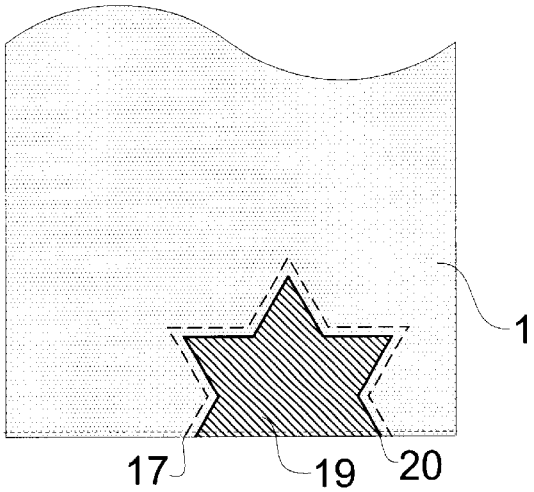
Figure 11:
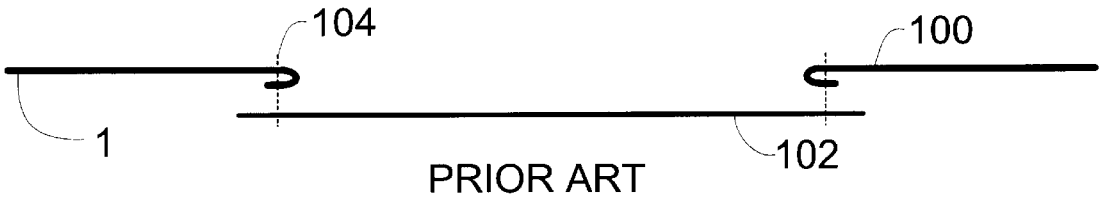
FIG. 11 illustrates the prior art.

FIG. 9A illustrates another embodiment of the face view of the finished design. The folded edge 20 acts as a transition between the first piece of fabric 1 and the second piece of fabric 19. The finished design appears to have no indentation and no fusible material visible along folded edge 20. As a transition, the fold line 20 can be any shape or length, extending from one edge of the fabric to the other. The second piece of fabric 19 extends beyond the folded edge of the design 20 such that stitching 17 joins the first piece of fabric 1 and the second piece of fabric 19.

Although the present invention was discussed in terms of certain preferred embodiments, the description is not limited to such embodiments. Rather, the invention includes other embodiments including those apparent to a person of ordinary skill in the art. Thus, the scope of the invention should not be limited by the preceding description but should be ascertained by reference to the claims that follow.

What is claimed is:

1. A method of creating a design on a first piece of material having a face side and a reverse side, comprising the steps of:

(a) placing a piece of fusible material overlapping said first piece of material, said fusible material having a first and second side, said first side having an adhesive, said second side of the fusible material being in contact with said face side of said first piece of material;

(b) stitching through said first piece of material and said piece of fusible material, thereby stitching said first piece of material and said piece of fusible material together, said stitching defining a boundary, said boundary defining a periphery of a design;

(c) trimming said fusible material outside said periphery of the design;

(d) cutting through said first piece of material and said piece of fusible material inside the periphery of the design forming an aperture;

(e) pulling said fusible material through said aperture such that said adhesive is substantially interposed between said first side of the fusible material and said reverse side of the first piece of material;

(f) fusing said fusible material to said reverse side of said first piece of material;

(g) placing a second piece of material on said second side of said fusible material, said second piece of material covering said aperture; and (h) stitching said second piece of material to said first piece of material and said piece of fusible material, wherein said second piece of material creates a finished design in said first piece of material.

2. The method according to claim 1 wherein said design is an unbroken design.

3. The method according to claim 1 wherein said stitching through said first piece of material and said fusible material is about 8 to 15 stitches per inch.

4. The method according to claim 1 wherein said fusible material outside the periphery of the design is trimmed to within about ½ inch of said boundary.

5. The method according to claim 1 wherein said first piece of material and said piece of fusible material inside the periphery of the design are cut to within about ⅙ inch of said boundary.

6. The method according to claim 5 wherein said first piece of material and said piece of fusible material are cut with a device chosen from the group consisting of a scissor, a blade, a laser, and a die.

7. The method according to claim 1 wherein said fusing is done by heat.

8. The method according to claim 1 wherein said fusing is done by pressure.

9. The method according to claim 1 further comprising the step of ironing said finished design on the reverse side of said first piece of material.

10. The method according to claim 1 wherein said stitching said second piece of material to said first piece of material and said piece of fusible material is about 12 to 15 stitches per inch.

11. The method according to claim 1 wherein said stitching defining a boundary follows a pre-drawn pattern.

* * * * *